US011534769B2

(12) United States Patent
Skog et al.

(10) Patent No.: US 11,534,769 B2
(45) Date of Patent: Dec. 27, 2022

(54) GYRATORY CRUSHER BOTTOMSHELL WITH INSPECTION HATCH ASSEMBLY

(71) Applicant: SANDVIK SRP AB, Svedala (SE)

(72) Inventors: Michael Skog, Lund (SE); Adrien Henssien, Malmo (SE); Sonny Ek, Svedala (SE); Mikael Larsson, Eslov (SE); Magnus Fredriksson, Dalby (SE); Jan Johansson, Lomma (SE)

(73) Assignee: SANDVIK SRP AB, Svedala (SE)

( * ) Notice: Subject to any disclaimer, the term of this patent is extended or adjusted under 35 U.S.C. 154(b) by 119 days.

(21) Appl. No.: 16/965,555

(22) PCT Filed: Jan. 31, 2018

(86) PCT No.: PCT/EP2018/052445
§ 371 (c)(1),
(2) Date: Jul. 28, 2020

(87) PCT Pub. No.: WO2019/149358
PCT Pub. Date: Aug. 8, 2019

(65) Prior Publication Data

US 2021/0046484 A1 Feb. 18, 2021

(51) Int. Cl.
*B02C 2/04* (2006.01)
*B02C 2/00* (2006.01)

(52) U.S. Cl.
CPC ..... *B02C 2/04* (2013.01); *B02C 2/005* (2013.01); *B02C 2210/01* (2013.01)

(58) Field of Classification Search
CPC .... B02C 2/00; B02C 2/02; B02C 2/04; B02C 2/06; B02C 2/005
See application file for complete search history.

(56) References Cited

U.S. PATENT DOCUMENTS

| | | | | |
|---|---|---|---|---|
| 3,843,068 | A | 10/1974 | Allen et al. | |
| 2002/0170994 | A1 | 11/2002 | Van Mullem | |
| 2015/0182970 | A1* | 7/2015 | Bergman | B02C 2/007 241/301 |
| 2015/0196922 | A1* | 7/2015 | Bergman | B02C 2/007 241/285.2 |
| 2015/0314300 | A1* | 11/2015 | Malmqvist | B02C 2/007 241/285.2 |
| 2015/0314301 | A1* | 11/2015 | Bergman | B02C 13/286 241/285.2 |
| 2016/0051987 | A1* | 2/2016 | Eriksson | B02C 23/00 241/285.2 |
| 2016/0279641 | A1* | 9/2016 | Nikolic | B02C 13/286 |

FOREIGN PATENT DOCUMENTS

| | | | |
|---|---|---|---|
| CN | 204107625 | U | 1/2015 |
| EP | 2789390 | A1 | 10/2014 |
| EP | 2589949 | A1 | 4/2015 |
| WO | 2010071565 | A1 | 6/2010 |

* cited by examiner

*Primary Examiner* — Faye Francis
(74) *Attorney, Agent, or Firm* — Corinne R. Gorski

(57) ABSTRACT

A gyratory crusher bottomshell and inspection hatch assembly is attachable exclusively to the bottomshell via a wear plate positioned at an internal region of the bottomshell. A wall thickness of the bottomshell at a border region immediately surrounding the hatch opening is generally equal to or less than a wall thickness over a remainder region of the wall at the same axial height position of the hatch opening.

14 Claims, 8 Drawing Sheets

GYRATORY CRUSHER BOTTOMSHELL WITH INSPECTION HATCH ASSEMBLY

RELATED APPLICATION DATA

This application is a § 371 National Stage Application of PCT International Application No. PCT/EP2018/052445 filed Jan. 31, 2018.

FIELD OF INVENTION

The present invention relates to a gyratory crusher bottomshell and an inspection hatch assembly for mating at the bottomshell that does not require specific modification at the region around the hatch opening.

BACKGROUND ART

Gyratory crushers are used for crushing ore, mineral and rock material to smaller sizes. Typically, the crusher comprises a crushing head mounted upon an elongate main shaft. A first crushing shell (referred to as a mantle) is mounted on the crushing head and a second crushing shell (referred to as a concave) is mounted on a frame such that the first and second shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. An example gyratory crusher is described in WO 2010/071565.

The crushing frame is typically formed from a topshell and a bottomshell to house the rotating main shaft and crushing head. An inspection hatch is commonly provided through the bottomshell wall to allow maintenance axis to the internal chamber to remove and dislodge crushable material and to inspect the various internal components at regular intervals (typically once a month). Conventionally, a thickness of the bottomshell wall around the hatch opening is oversized and is also machined to provide a planar surface to mount the hatch door or hatch frame. The oversized border around the hatch opening is disadvantageous for a number of reasons. In particular, the arrangement of material feeders that introduce the flowable melt into the cast can be complex and due to the oversizing around the hatch opening the restricted flow path can lead to porosity of the resulting bottomshell cast. Additionally, the oversized wall at the hatch opening requires machining which is disadvantageous with regard to additional processing time, tooling, personnel and energy use. The thickened hatch border region also limits the maximum wall thickness of the bottomshell and accordingly limits the achievable bottomshell strength characteristics. Accordingly, what is required is a bottomshell and hatch assembly to addresses the above problems.

SUMMARY OF THE INVENTION

It is an objective of the present invention to provide a bottomshell for a gyratory crusher and a gyratory crusher inspection hatch assembly that, via its mechanism of attachment at the region of the bottomshell facilitates manufacture of the bottomshell by avoiding the need for a machined and oversized wall at the border region immediately surrounding the hatch opening. It is a further specific objective to provide a bottomshell and hatch assembly that enables the casting of bottomshells with enhanced strength and with a reduced risk of imperfections and in particular porosity at the region around the hatch opening resultant from the casting process.

It is a further specific objective to provide a bottomshell for a gyratory crusher via a hatch opening assembly and mechanism of attachment at the region of the bottomshell that does not require specific attachment of the hatch assembly to the bottomshell wall to obviate the need for machining and boring the bottomshell at the region of the hatch opening so as to mount a hatch door and/or hatch frame. Accordingly, it is a specific objective to minimise the occurrence of stress concentrations within the bottomshell during use.

The objectives are achieved by providing a hatch assembly that may be mounted at the bottomshell via one of the liner wear plates that are mounted at an internal facing surface of the bottomshell such that the hatch assembly is not mounted directly to the bottomshell wall. Additionally, casting of the bottomshell is greatly facilitated as the bottomshell according to the subject invention does not comprise an oversized wall thickness at the border region immediately surrounding the hatch opening. As such, the complexity of the material feeders is greatly reduced in addition to reducing the risk of imperfections and in particular porosity within the bottomshell at the region of the hatch opening.

As the present bottomshell comprises a generally uniform wall thickness in a plane perpendicular to a longitudinal axis of the bottomshell, at the axial position of the hatch opening, the entire wall thickness in the circumferential direction may be increased relative to conventional arrangements as greater clearance is provided for the attachment bolts (at the region of the hatch opening) that couple the topshell and bottomshell.

Within this specification, reference to a 'border region' encompasses a section of the bottomshell wall that extends immediately around each hatch opening. This border region may be considered to extend over a distance in the axial and circumferential direction that is approximately equal to the radius of each hatch opening (or approximately half of the opening width in a circumferential direction around the bottomshell). The border region may extend in a circumferential direction from the hatch opening and in particular from an internal facing surface or edge that defines the hatch opening by an angular distance in the range 1 to 40°, 1 to 30°, 1 to 20°, 1 to 10°, 1 to 5°, 5 to 40°, 5 to 30°, 5 to 20° or 5 to 10°.

Reference within this specification to a 'remainder region' encompasses regions of the bottomshell wall that are positioned outside of the border region and are positioned at the same axial height as the border region with respect to a longitudinal axis extending through the bottomshell. The remainder region may be considered to comprise those sections of the bottomshell that extend in a circumferential direction between the diametrically opposed hatch openings and are positioned at the same axial position as the respective hatch openings.

According to a first aspect of the present invention there is provided a gyratory crusher bottomshell comprising: an annular wall extending around a longitudinal axis of the bottomshell, the annular wall having a radially outward facing surface, a radially inward facing surface, an annular axial upper end and an annular axial lower end; at least one hatch opening provided through the annular wall; characterised in that: at a border region of the wall surrounding the hatch opening a radial thickness of the wall is not greater than a radial wall thickness over a remainder region of the wall outside of the border region at the same corresponding axial position of the hatch opening.

Preferably, the thickness of the wall at the border region is generally equal to the wall thickness at a remainder region or position of the wall separated from the hatch opening by an angular distance of 10 to 30°, 20 to 40°, 50 to 70°, 80 to 100°, 110 to 130°, 140 to 160°, 20 to 120°, 40 to 140°, 60 to 120° or an angular distance of 20 to 160°, 30 to 150°, 40 to 140°, 50 to 130°, 60 to 120°, 70 to 110° or approximately 85 to 95° in the circumferential direction around the axis. A uniform wall thickness at an axial position of the topshell aligned with the hatch openings is advantageous to distribute uniformly loading forces around the bottomshell and to minimise the occurrence of stress concentrations at specific regions. A uniform cross sectional are in a plane perpendicular to the longitudinal axis of the bottomshell also facilitates casting and reduces the likelihood of undesirable porosity during casting that persists to the final cast article.

Preferably, a thickness of the wall at the border region about the hatch opening does not increase in a circumferential and axial direction towards the hatch opening from the remainder region of the wall. The hatch opening may accordingly be formed from continually curved surfaces and a wall thickness within the border region that decreases gradually in the axial direction such that the wall thickness is tapered inwardly towards a centre of the hatch opening. Such an arrangement further facilitates casting when feeding cast material into the mould from axial upper and lower positions.

Preferably, a shape profile of the radially outward facing surface in a plane perpendicular to the longitudinal axis is generally continuously convex at the border region. This continuously curved shape profile minimises stress concentrations and accordingly extends the operational lifetime of the bottomshell. In particular, the radially outward facing surface at the border region is devoid of any planar surfaces and is generally continuously curved in the circumferential direction. Advantageously, the border region is devoid of any machined surfaces. Such surfaces that are otherwise conventionally required to mount hatch frame parts including hatch assemblies and hatch mounting mechanisms are time inefficient to form and can weaken the bottomshell as providing potential crack nucleation sites. The border region is also devoid of any threaded attachment bores that may otherwise increase the likelihood of stress concentrations and increase the risk of fatigue and cracking of the bottomshell at the region around the hatch openings.

Preferably, a thickness of the bottomshell wall within the border region decreases in the axial direction towards a centre of the hatch opening from the axial upper end and/or axial lower end of the wall.

Preferably, an inner surface of the wall that defines the hatch opening between the radially outward and inward facing surfaces comprises curved regions so as to provide regions that are devoid of edges. Sharp edges within the bottomshell are disadvantageous as providing regions where stress concentrations may originate and can result in casting imperfections.

According to a second aspect of the present invention there is provided a gyratory crusher inspection hatch assembly for a gyratory crusher comprising: a bottomshell as claimed herein; a frame having an annular projection capable of being mounted to sit radially within the hatch opening between the radially inward and outward facing surfaces; and a door mountable at the frame to close the hatch opening.

Preferably, the inspection hatch assembly further comprises a wear plate having an aperture, the wear plate mountable to the radially inward facing surface of the bottomshell, a radially inner end of the annular projection in fixed attachment to the wear plate so as to extend radially outward from the wear plate at a region of the aperture and through the annular wall via the hatch opening. The wear plate may be considered to form part of the inspection hatch assembly in addition to forming part of the liner assembly that is in turn formed by individual liner plates positioned side-by-side around the interior of the bottomshell. The wear plate preferably forms part of a wear plate liner assembly attachable to the bottomshell via attachment bolts that extend through bores extending radially through the bottomshell wall. Preferably, the aperture of the wear plate may be the same or similar in shape and dimension to the hatch opening of the bottomshell. Preferably, the size of the aperture is considered to take up the double casting tolerance for the bottomshell hole. Preferably, the aperture is circular.

Preferably, the annular projection is fixed to the wear plate at a perimeter of the aperture via a weld material. Optionally, the annular projection is friction-fitted into mating engagement with the aperture of the wear plate. Optionally, the annular projection may be fixed by bolts, screws, pins, plugs, bayonet fixings and/or adhesive within the perimeter of the aperture. Optionally, the frame may be formed integrally with the wear plate.

Preferably, the frame further comprises a rim provided at a radially outer end of the annular projection and extending at least part annually around the annular projection. Preferably, the rim comprises a door mount face to mate with a complementary surface of the door to mount the door at the frame and to close the hatch opening.

Preferably, the assembly further comprises a compressible or deformable collar mountable around a region of the annular projection, at least a portion of the collar configured to sit radially between a region of a radially outward facing attachment face of the wear plate and a portion of the border region of the annular wall. Optionally, the compressible or deformable material comprises a foam or rubber material. The collar material may be elastically deformable or may be fixed or set in the compressed configuration following initial mounting of the hatch assembly at the bottomshell.

According to a further aspect of the present invention there is provided a gyratory crusher inspection hatch assembly for mounting at a hatch opening within an annular wall of a gyratory crusher bottomshell comprising: a wear plate mountable at a radially inward facing surface of the bottomshell and having an aperture; a frame having a hollow annular projection in fixed attachment to the wear plate such that at least a first end of the annular projection is dimensioned to sit immediately around or within the aperture; and a door detachably mountable to the frame to close a hollow interior of the annular projection.

Preferably, a length of the projection is configured to take up the double casting tolerance of the thickness of the bottomshell.

According to a further aspect of the present invention there is provided a gyratory crusher inspection hatch assembly for mounting at a hatch opening within an annular wall of a gyratory crusher bottomshell comprising: a projection for attachment to a wear liner plate attachable to a radially inward facing surface of the bottomshell, the projection capable of extending at least partially through the hatch opening from the radially inward facing surface of the bottomshell towards a radially outward facing surface of the bottomshell; and a door mountable across and/or within projection to close the hatch opening; wherein the assembly is capable of mounting at the bottomshell exclusively via the wear liner plate.

According to a further aspect of the present invention there is provided a gyratory crusher comprising an inspection hatch assembly as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
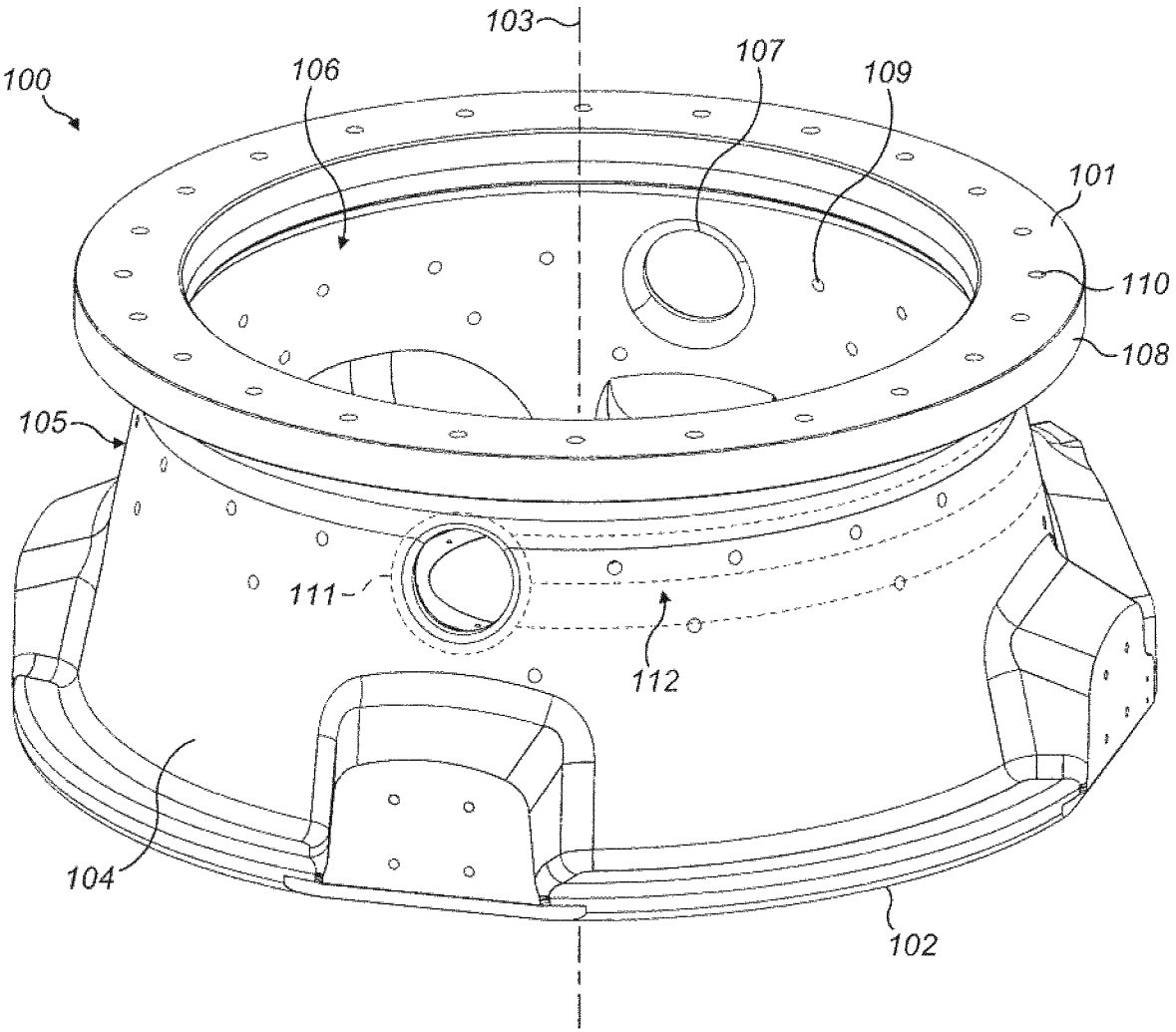
FIG. 1 is a perspective view of a gyratory crusher bottomshell according to a specific implementation of the present invention.

Referring to FIG. 1, a gyratory crusher bottomshell 100 comprises an annular wall 104 extending around a longitudinal axis 103 of the bottomshell 100. Wall 104 comprises a radially outward facing surface indicated generally by reference 105 and a radially inward facing surface 106 that defines an internal chamber within the bottomshell 100. Wall 104 is terminated at an axial upper end by an annular rim 108 having an annular upward facing planar surface 101. A plurality of attachment bores 110 extend axially through rim 108 to receive attachment bolts for the coupling of a topshell (not shown) to the bottomshell 100 to form the main frame part of the gyratory crusher. A corresponding axial lower end of bottomshell 100 similarly comprises a generally annular rim 102 for mounting against a base or lower support structure.

A pair of diametrically opposed hatch openings 107 extend through wall 104 to allow inspection access into the internal chamber defined by radially inward facing surface 106. Each hatch opening 107 comprises a generally circular shape profile. According to the subject invention, a border region indicated generally by reference 111 at the bottomshell wall 104 immediately surrounding each hatch opening 107 does not comprise an oversized wall thickness. That is, a radial thickness of wall 104 at the border region 111 is not greater than and in particular is substantially equal to a wall thickness at a remainder region 112 of the bottomshell 100 outside of the border region 111 at the same respective axial position relative to axis 103. That is, in a circumferential direction around bottomshell 100, wall 104 comprises a generally uniform radial thickness within remainder region 112 and within border region 111 immediately surrounding each hatch opening 107.

Figure 2:
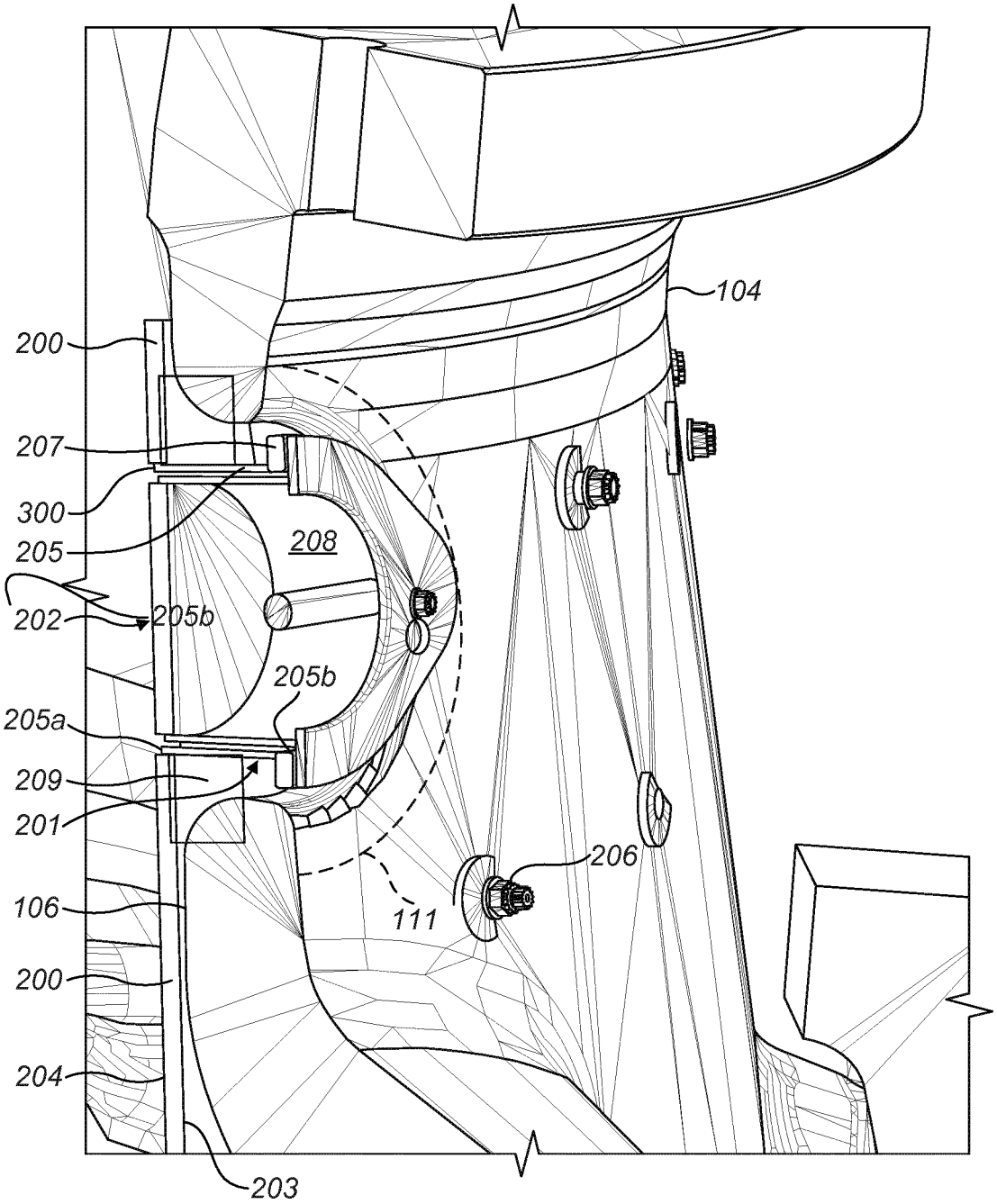
FIG. 2 is a cross sectional perspective view of an inspection hatch assembly mounted at a hatch opening of the bottomshell of FIG. 1.
Figure 3:
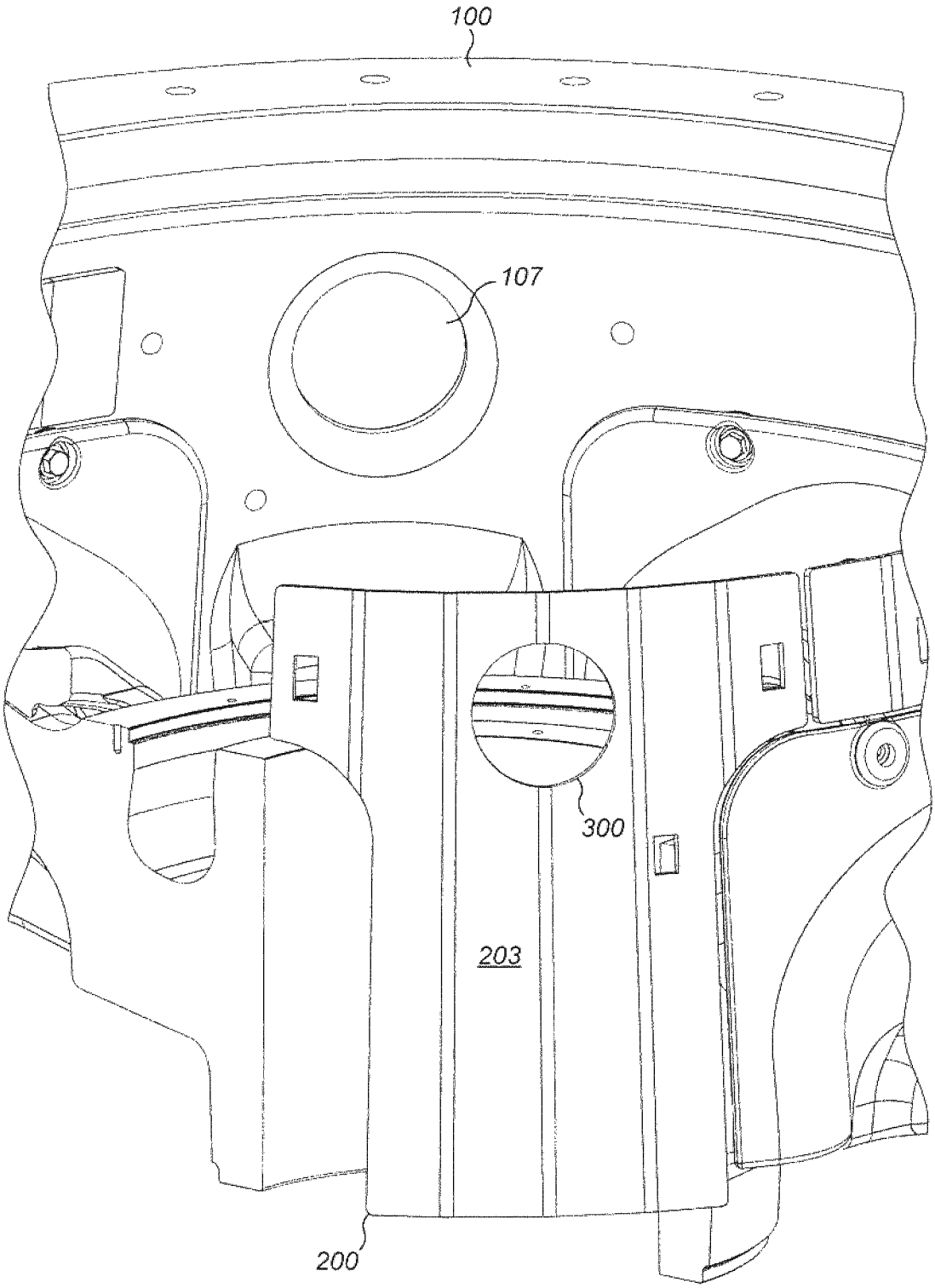
FIG. 3 is a perspective view of part of the bottomshell of FIG. 1 illustrating selected wear plates mounted internally at the bottomshell.

Referring to FIGS. 2 and 3, a hatch assembly is mounted at each hatch opening 107 of bottomshell 100. The hatch assembly comprises a frame indicated generally by reference 201; a door part indicated generally by reference 202; and a liner wear plate 200 that is secured to wall 104 via a plurality of attachment bolts 206 that extend through bores 109 provided through wall 104 between the radially outward and inward facing surfaces 105, 106. Wear plate 200 comprises a radially inward facing wear surface 204 and a radially outward facing attachment face 203 for positioning against internal facing surface 106 of bottomshell 100. As will be appreciated, wear plate 200 forms part of a liner assembly to protect bottomshell surface 106 from the bulk material as it falls from the crushing zone through the bottomshell 100. The liner assembly comprises a set of individual wear plates that are positioned side-by-side in an annular configuration around bottomshell inward facing surface 106. The wear plate 200 referred to herein represents one plate part of such a liner assembly.

Frame 201 comprises annular projection 205 having a generally cylindrical shape and configuration. A respective first inner axial end 205*a* of projection 205 is positioned approximately coplanar with wear plate 200 whilst a respective second axial end 205*b* extends beyond bottomshell outward facing surface 105. An annular rim 207 is mounted to and extends outwardly from annular projection second end 205*b* to provide a respective mounting region for a part of door 202 as described below.

Wear plate 200 comprises an aperture 300. According to the specific implementation, aperture 300 is circular although other shape profiles may be suitable. The first end 205*a* of annular projection 205 is appropriately dimensioned (in diameter) so as to sit within aperture 300 in close fitting contact against a region of wear plate 200 that defines a perimeter of aperture 300. Door 202 is configured to sit within a hollow interior 208 of the annular projection 205 and to extend the complete length of the cylindrical interior 208 between ends 205*a* and 205*b*.

As illustrated in FIG. 2, the hatch assembly further comprises a deformable and/or compressible collar 209 that is mountable to surround in part of annular projection 205. In particular, collar 209 is configured to sit against a part of wear plate outer surface 203 and an outer facing surface 508 (FIG. 5) of annular projection 205. Collar 209 is dimensioned such that at least during initial assembly, collar 209 is larger than the space or volume available at the region of the hatch opening 107 surrounding the annular projection 205. Accordingly, when wear plate 200 is drawn radially outward via the tightening of attachment bolts 206, collar 209 is compressed (or deformed) between wear plate 200 and the border region 111 of bottomshell 100 at the region immediately surrounding hatch opening 107. Such a configuration is advantageous to prevent the passage of dust and debris from the internal chamber of bottomshell 100 into the region of the hatch opening 107 and past the annular projection 205. Accordingly, collar 209 is configured to provide a dust or debris seal at the hatch opening 107 that is effective for particle containment during crushing operations. Wear plate aperture 300, (to which the door frame 201 is attached), is dimensioned to correspond approximately, and in particular to be slightly smaller than, with that of hatch opening 107 such that when door 202 is removed from frame 201 access may be gained to the bottomshell internal chamber (defined by wall 104).

Figure 4:
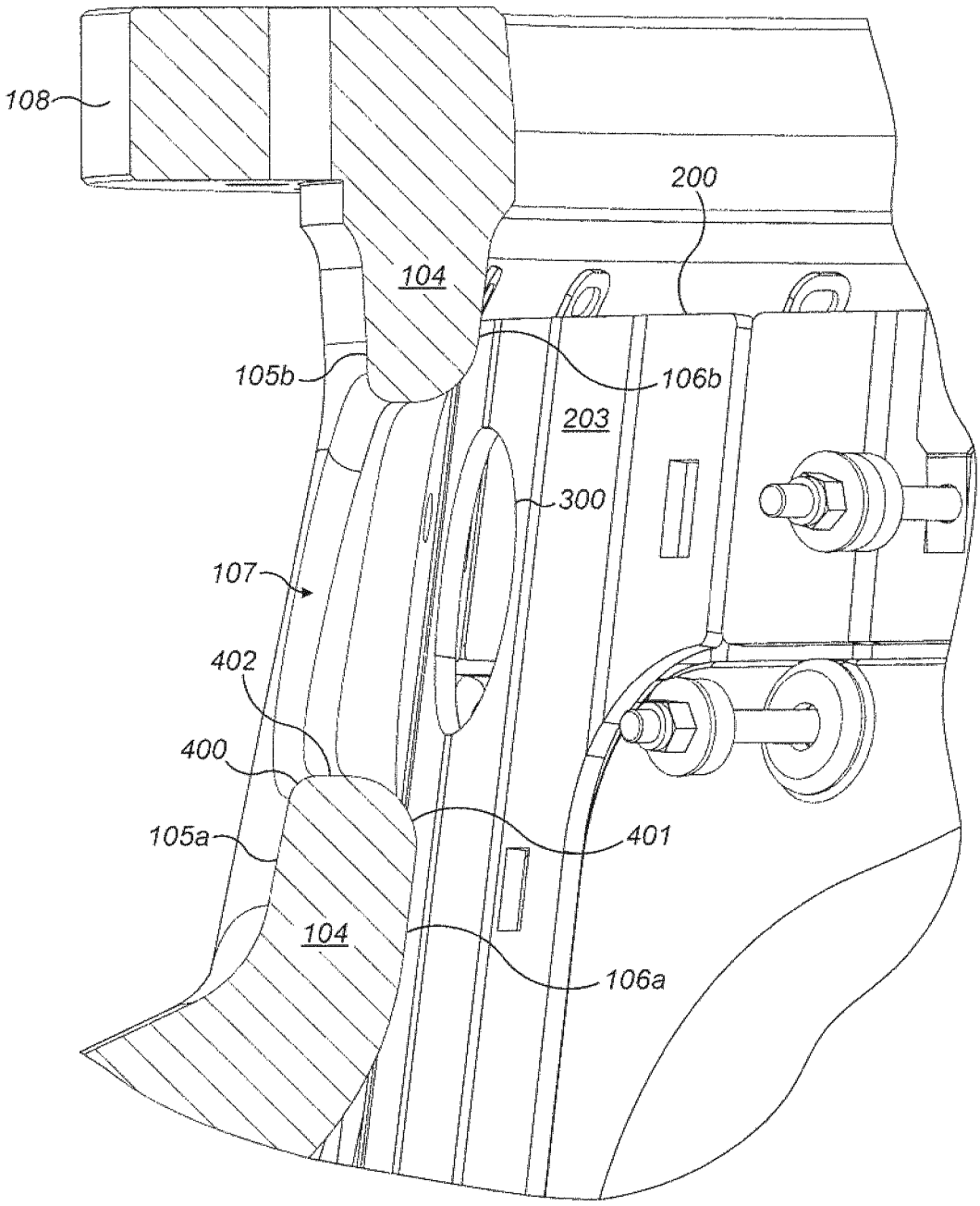
FIG. 4 is a further cross sectional perspective view of the bottomshell of FIG. 1 comprising the internally mounted wear plates of FIG. 3.
Figure 8:
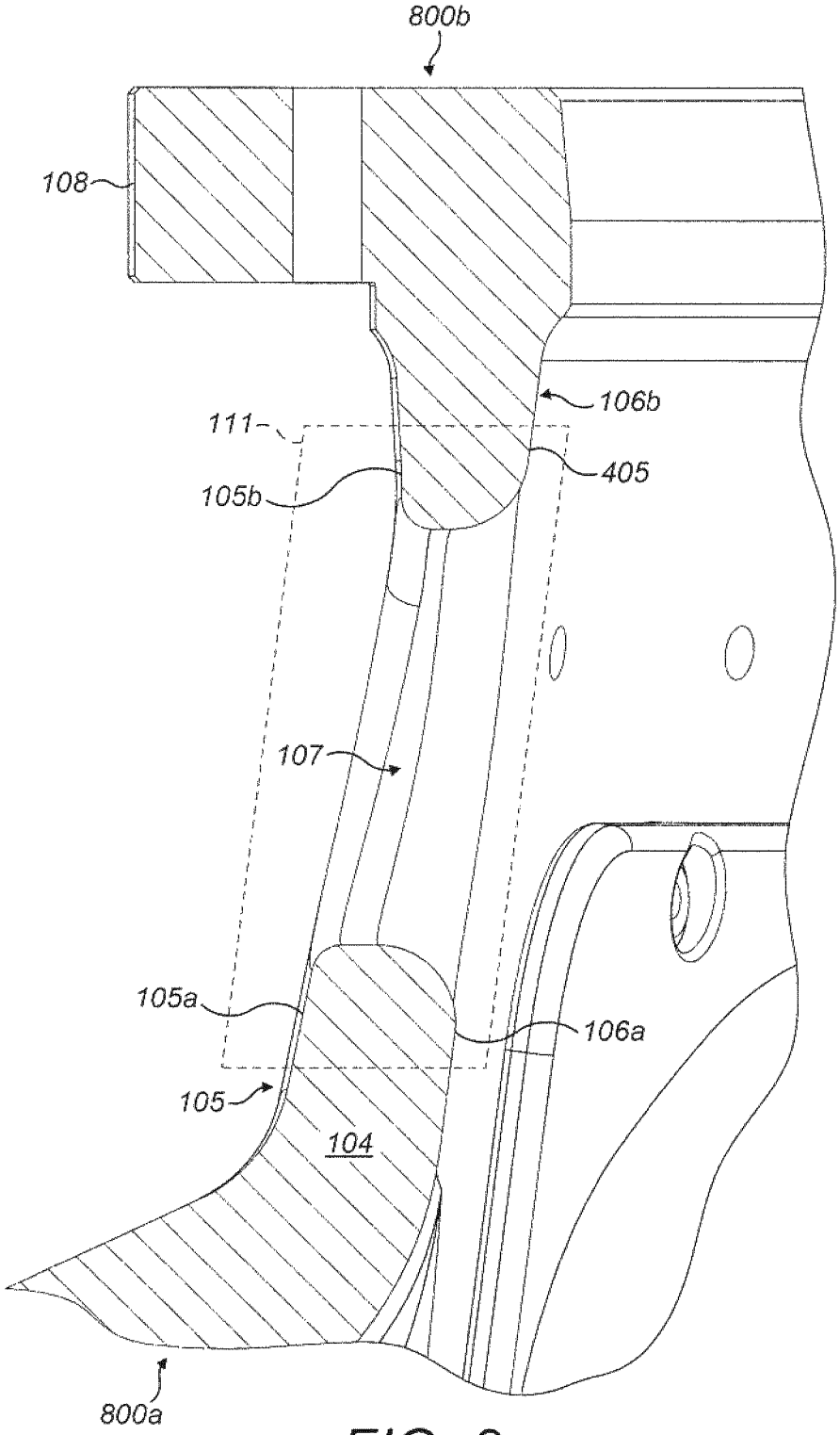
FIG. 8 is a further cross sectional perspective view of the bottomshell of FIG. 1 at the region of the hatch opening.

Referring to FIGS. 4 and 8, a radial thickness of wall 104 immediately surrounding each hatch opening 107 (defined herein as the border region 111) is consistent with a corresponding wall thickness at the same axial position (or corresponding plane perpendicular to axis 103) such that the wall 104 at border region 111 is not oversized according to conventional bottomshell wall configurations at the region surrounding each hatch opening 107. In particular, the external facing surface 105*a*, 105*b* within border region 111 at a respective axial positions below and above hatch opening 107 tapers radially inward so as to be either linear or concave relative to axis 103. A corresponding region 106*a*, 106*b* of radially internal facing surface 106 within the border region 111 axially below and above, respectively hatch opening 107, is similarly aligned to taper or is curved inwardly with respect to the corresponding outward facing surface regions 105*a*, 105*b*. The decreasing taper of the respective external and internal facing surfaces 105, 106 extends annually around hatch opening 107 and is not exclusive to a plane aligned axially with longitudinal axis 103. That is, such tapering of surfaces 105, 106 is also present at the bottomshell 100 in a plane extending transverse or perpendicular to longitudinal axis 103. Accordingly, the thickness of wall 104 within border region 111 is tapered annularly so as to decrease towards the axial centre of the circular hatch opening 107 from a position outside of the border region 111. Accordingly, a wall thickness within the border region 111 is equal to or less than a thickness of the bottomshell wall at the remainder region 112 of the bottomshell 100 outside of the border region 111.

Referring to FIG. 8, such a configuration is advantageous to facilitate introduction of the casting material into the mould during casting of the bottomshell 100 via a first feed orientation 800*a* at lower annular rim 102 and a second feed orientation 800*b* at upper annular rim 108. It will be appreciated that conventional hatch openings typically comprise an enlarged wall thickness at border region 111 as the wall 104 is flared radially outward so as to provide a planar mount face corresponding to surface regions 105*a*, 105*b*. Such radially extended shoulders increase the risk of porosity within the wall 104 during casting. Due to the tapering wall thickness at least in the axial direction of wall 104, within border region 111, and a corresponding generally uniform wall thickness within border region 111 and remainder region 112, casting is facilitated and the risk of imperfections and porosity within wall 104 at the border region 111 is reduced significantly. Additionally, the general thickness of wall 104 may be increased relative to conventional bottomshell arrangements whilst still providing sufficient radial clearance to receive the attachment bolts (not shown) through attachment bores 110 without fouling against the external facing surface 105 particularly at the border region 111.

The subject invention is further advantageous by comprising hatch openings 107 that are devoid of angled or sharp edges. In particular and referring to FIG. 4, an inner surface 402 that defines hatch opening 107 (that extends in a general radial direction between the radially outward and inward facing surfaces 105, 106) terminates at respective radial outer and inner ends that are defined by respective curved regions 400, 401 that provide the respective interfaces with the radially outward and inward facing surfaces 105, 106. Accordingly, the surface that defines the hatch opening 107 from a radially outward 105 to inward 106 facing surfaces is devoid of sharp annular edges or edge regions.

Figure 5:
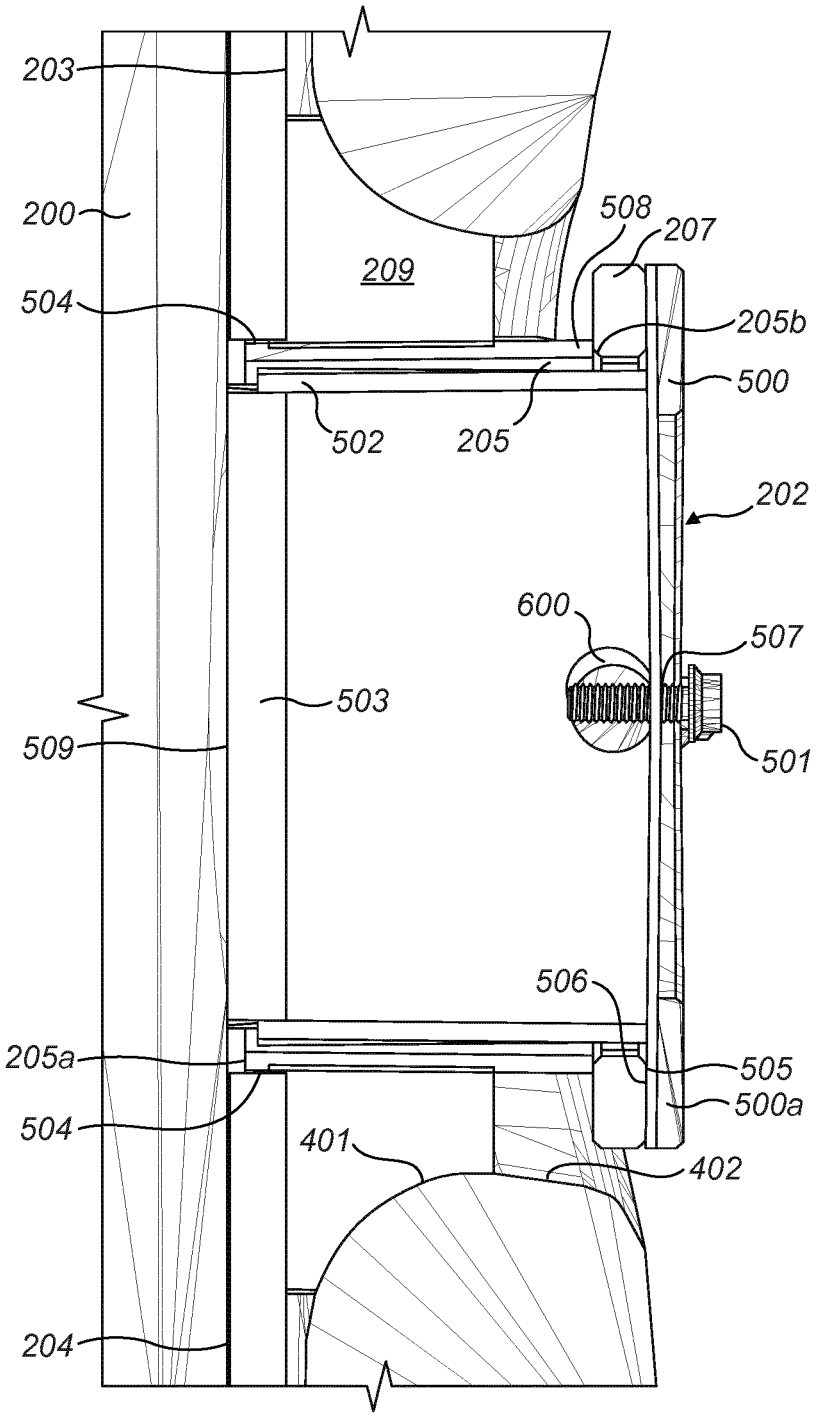
FIG. 5 is a perspective view of components of the hatch assembly of FIG. 2.
Figure 6:
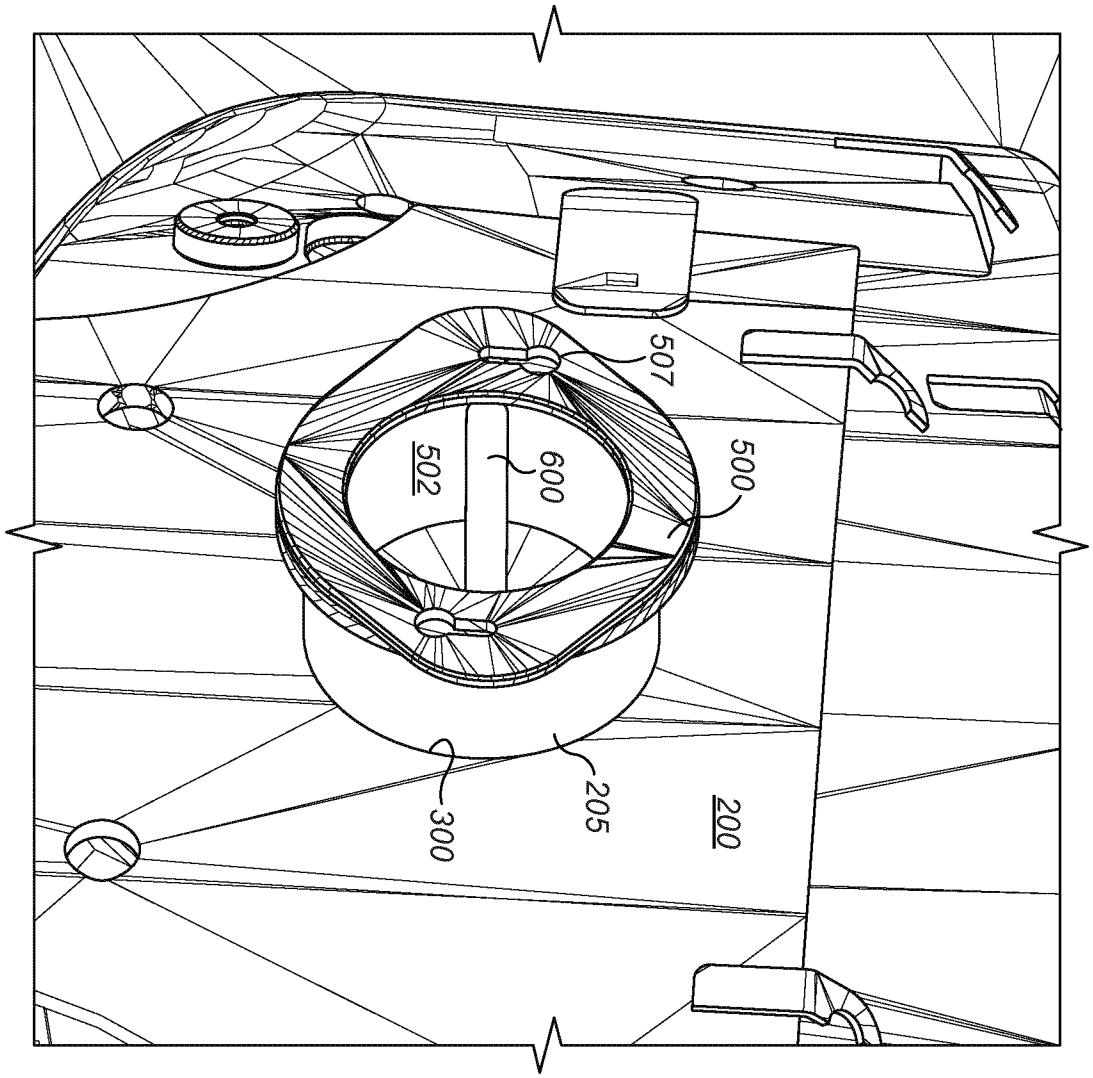
FIG. 6 is a further perspective cross sectional view of the components of the hatch assembly of FIG. 2.
Figure 7:
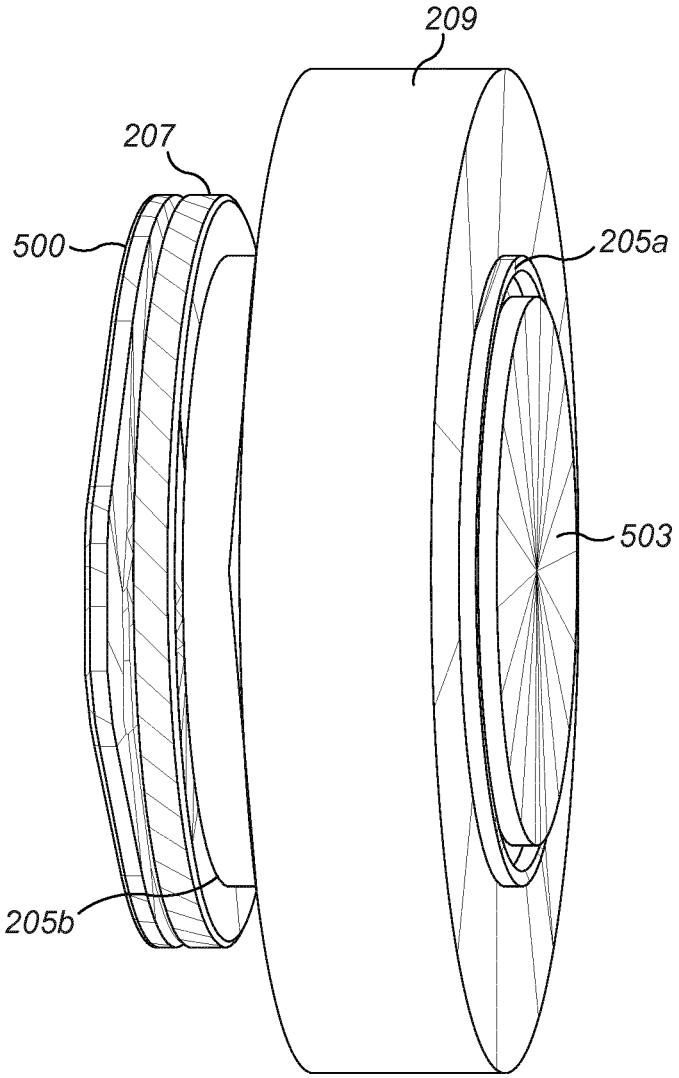
FIG. 7 is a further perspective view of the components of the hatch assembly of FIG. 2.

Referring to FIGS. 5 to 7, door 202 comprises a disc-shaped inner end plate 503 that provides a base for a generally cylindrical section 502, with end plate 503 positioned at one axial end of section 502. An annular flange 500 is mounted at a second axial end 502*b* of section 502 and has a portion that projects radially outward so as to form a rim 500*a* having a mating surface 506 configured for abutment contact with a door mount face 505 provided at rim 207 of frame 201. Accordingly, door 202 is capable of being inserted into and removed from the hollow interior 208 (defined by annular projection 205) such that a surface 509 of plate 503 is aligned approximately coplanar with inward facing wear plate surface 204 with this alignment established and maintained via abutment contact between the respective surfaces 505, 506. As indicated, during initial mounting of the hatch assembly at the hatch opening 107, collar 209 is placed around annular projection 205 to be in contact with the generally cylindrical projection surface 508. By tightening bolts 206, collar 209 is compressed between the three opposing surfaces 203, 401 and 508 as the wear plate 200 is drawn radially outward into touching contact against bottomshell surface 106.

Annular projection 205, rim 207 and door 202 may be formed from a steel whilst wear plate 200 is formed from a high hardness wear resistant material as will be appreciated. Annular projection 205 at inner end 205*a* is secured and fixed permanently to wear plate 200 at the defining perimeter of aperture 300 via a suitable weld material 504.

To secure door 202 at the hatch opening 107 (within hollow interior 208), attachment bolts 501 are mountable within 'keyhole' shaped bolt receiving holes (or slots) 507 extending through flange 500 and door frame rim 207. Bolts 501 are preferably captive and comprise a washer, spring or the like at an innermost axial end so the bolts 501 are retained in position at rim 207 when door 202 is removed. Door 202 further comprises a bar-shaped handle 600 extending diametrically across and secured within the cylindrical section 502.

Accordingly, the frame 201 and door 202 are secured to bottomshell 100 via the intermediate wear plate 200 and associated attachment bolts 206. That is, frame 201 and door 202 are not secured directly to the bottomshell wall 104 via separate and specific attachment bores and bolts and an otherwise machined mount face located at the border region 111 according to conventional bottomshell and hatch assemblies. The bottomshell wall 104 of the subject invention at the border region 111 is not adapted for mating with the present hatch assembly and instead may be optimised to reduce the risk of imperfection within the internal structure of wall 104 (including in particular porosity) and moreover may be optimised to minimise stress concentrations and hence to maximise the operational lifetime of the bottomshell 100. In particular, the bottomshell wall 104 at the radially outward facing surface 105 is continuously convex within the border region 111 and the remainder region 112 such that each hatch opening 107 is formed seamlessly within the bottomshell wall 104.

The invention claimed is:

1. A gyratory crusher bottomshell comprising:

an annular wall extending around a longitudinal axis of the bottomshell, the annular wall having a radially outward facing surface, a radially inward facing surface, an annular axial upper end and an annular axial lower end; and at least one hatch opening provided through the annular wall, wherein at a border region of the wall surrounding the hatch opening a radial thickness of the wall is not greater than a radial wall thickness over a remainder region of the wall outside of the border region at the same corresponding axial position of the hatch opening.

2. The bottomshell as claimed in claim 1, wherein the thickness of the wall at the border region is equal to the wall thickness at a position of the wall separated from the hatch opening by an angular distance of 90° in the circumferential direction around the axis.

3. The bottomshell as claimed in claim 1, wherein a thickness of the wall at the border region about the hatch opening does not increase in a circumferential and axial direction towards the hatch opening from the remainder region of the wall relative to the longitudinal axis.

4. The bottomshell as claimed in claim 1, wherein a shape profile of the radially outward facing surface in a plane perpendicular to the longitudinal axis is generally continuously convex at the border region.

5. The bottomshell as claimed in claim 1, wherein the radially outward facing surface at the border region is devoid of any planar surfaces and is generally continuously curved in the circumferential direction around the longitudinal axis.

6. The bottomshell as claimed in claim 1, wherein a radial thickness of the wall within the border region decreases in the axial direction towards the hatch opening from the axial upper end and/or the axial lower end of the wall.

7. The bottomshell as claimed in claim 1, wherein the hatch opening is at least in part defined by curved regions that extend in a generally radial direction between the inward and outward facing surfaces such that the hatch opening is devoid of edges.

8. A gyratory crusher inspection hatch assembly for a gyratory crusher comprising:

a bottomshell as claimed in claim 1;

a frame having an annular projection capable of being mounted to sit radially within the hatch opening between the radially inward and outward facing surfaces; and a door mountable at the frame to close the hatch opening.

9. The assembly as claimed in claim 8, further comprising a wear plate having an aperture, the wear plate mountable to the radially inward facing surface of the bottomshell, a radially inner end of the annular projection in fixed attachment to the wear plate so as to extend radially outward from the wear plate at a region of the aperture and through the annular wall via the hatch opening.

10. The assembly as claimed in claim 9, wherein the annular projection is fixed to the wear plate at a perimeter of the aperture via a weld material.

11. The assembly as claimed in claim 9, wherein the frame includes a rim provided at a radially outer end of the annular projection and extending at least part annually around the annular projection.

12. The assembly as claimed in claim 11, wherein the rim includes a door mount face arranged to mate with a complementary surface of the door to mount the door at the frame and to close the hatch opening.

13. The assembly as claimed in claim 9, further comprising a compressible or deformable collar mountable around a region of the annular projection, at least a portion of the collar configured to sit radially between a region of a radially outward facing attachment face of the wear plate and a portion of the border region of the annular wall.

14. The assembly as claimed in claim 13, wherein the collar is a foam or a rubber material.

* * * * *